US005306219A

United States Patent [19]

Solymosi

[11] Patent Number: 5,306,219

[45] Date of Patent: Apr. 26, 1994

[54] TRAINING MACHINE FOR ROWERS

[76] Inventor: Frank Solymosi, 255 Violet St., Massapequa Park, N.Y. 11762

[21] Appl. No.: 961,251

[22] Filed: Oct. 15, 1992

[51] Int. Cl.[5] ..... A63B 69/06

[52] U.S. Cl. ..... 482/73; 482/111

[58] Field of Search ..... 482/73, 111, 148, 72; 4/497; 440/101, 105, 113

[56] References Cited

U.S. PATENT DOCUMENTS 4,903,961 2/1990 Solymosi ..... 482/73

FOREIGN PATENT DOCUMENTS 0127888 4/1950 Sweden ..... 482/73
0597799 3/1978 U.S.S.R. ..... 482/73
1362486 12/1987 U.S.S.R. ..... 482/73
1526706 12/1989 U.S.S.R. ..... 482/73

*Primary Examiner*—Stephen R. Crow
*Attorney, Agent, or Firm*—Bauer & Schaffer

[57] ABSTRACT

A rowing machine for use indoors or outdoors, consisting of a rowing attachment with a sliding seat arrangement equipped with oars, which rowing attachment is mounted between two parallel, generally oblong water-filled tanks. Flow diverters are provided in the tanks to enhance water circulation and to simulate outdoor rowing conditions, including a longitudinal ducted assembly dividing the tank into two parallel sections to provide a circular flow path and having transverse passages for short circuitry of the circular flow of water. An enhanced diverting assembly is also provided at each end of the tank.

12 Claims, 5 Drawing Sheets

TRAINING MACHINE FOR ROWERS

BACKGROUND OF THE INVENTION

1. Field of the Invention

This invention relates to a rower's training apparatus which simulates the actual water resistance encountered by a rower as if rowing on a river or the like.

2. Description of the Prior Art

The invention relates to a rowing machine of the type in which a pair of generally oblong water-filled tanks straddle a tank in which the oarsman sits and manipulates the oars. Such a device is disclosed in my U.S. Pat. No. 4,903,961 dated Feb. 27, 1990. Briefly, the apparatus comprises a trio of parallel aligned oblong tanks; the rower sitting in the middle tank and operating the oars in each of the straddling tanks. In each of the side tanks, flow diverting means is employed comprising a plurality of horizontally oriented flow plates supported at each end of each tank, and a dividing wall extending along the longitudinal center line of the oblong tank. As the rower rows, the water circulates within the respective tanks. This relatively simple construction exhibits improved simulated water-resistance and wave motion over the then known prior art, and provides the rower with a realistic sense of movement. As a result, the apparatus is most useful for indoor training, particularly in foul weather.

While my previous apparatus was highly effective in providing the rower with an efficient training device and sufficient simulation of water flow to stimulate the rower's sense of movement, it provided water resistance that was significantly larger than would be found by the rower in the river or lake. Further, the diverting means a each end of the tank and the solid center wall tended to produce water cavitation as well as whirlpool and eddy effects as the speed and strength of the rower increased.

Therefore, there still exists a need for training apparatus which exhibits still further improved simulation of water resistance and wave motion such as would, in reality, be encountered in a river or a lake. The present invention fulfills this need.

OBJECTS OF THE INVENTION

It is an object of the present invention to provide a rowing apparatus which can be utilized for training purposes and which simulates the natural resistance encountered by the rower during rowing, going through all phases of sliding seat rowing such as the catch, drive, finish, release, feathering and recovery with improved effectiveness.

It is yet a further object of the present invention to provide a rowing machine which includes a pair of water-filled tanks designed to make the movement of water therein as smooth as possible by inserting improved flow diverters or wave breaks in one or both ends of the tanks.

It is another object of the present invention to provide a rower's training apparatus of the type heretofore described in which improved means are provided to reduce cavitation, excess wave production and their resultant bad effect on the rower.

It is another object of the present invention to provide a rower's training apparatus in which an improved seat is provided for the rower increasing the rower's sense of free and realistic movement.

The foregoing objects, together with other objects and their advantages, will be apparent from the foregoing description of the present invention.

SUMMARY OF THE INVENTION

In accordance with the present invention, there is provided apparatus for training rowers having an oblong tank filled with water and in which the rower manipulates an oar to simulate rowing. The tank is provided with dividing assembly extending longitudinally separating the tank into two parallel sections, to cause the flow of water created by the simulated rowing to take a circular path within said tank. The dividing assembly is provided with a plurality of transverse passages for short circuiting at least a portion of the water from one parallel section to the other.

Preferably the dividing assembly comprises a plurality of axially spaced laterally extending wall members such as blocks, defining between adjacent pairs the transverse passages. The wall members having an upper surface sloping from a height approximating the level of water in the tank to the bottom of the tank in each of the parallel sections. The surfaces of the wall members are curved.

The apparatus also includes a flow diverter located at each end of the tank. The diverter comprises a plurality of horizontally disposed, vertically spaced plates separated and supported by a plurality of vertically oriented walls spaced parallel to each other between adjacently stacked pairs of the plates thus defining a plurality of passageways between said plates. Preferably the vertically oriented walls are semicircular.

Still further, the apparatus provides improved means for suspending the boat comprising a plurality of cables attached to said boat to permit said boat to slide relative to said cables fore and aft in the tank. Preferably the suspension includes a sheath attached to each end of said boat. The sheath has a pair of tubular passages extending at angles to each other and is adapted to slideably receive a cable. The respective cables are attached in crossing fashion at one end to the respective end of the tank and at the opposite ends to opposing sides of the tank proximate the other end of the tank.

Full details are set forth in the following description of the invention which is to be taken in conjunction with the accompanying drawings. It is to be understood that the drawings are illustrative only, and similar reference numerals denote similar elements throughout the several views.

DESCRIPTION OF THE PREFERRED EMBODIMENT

Figure 1:
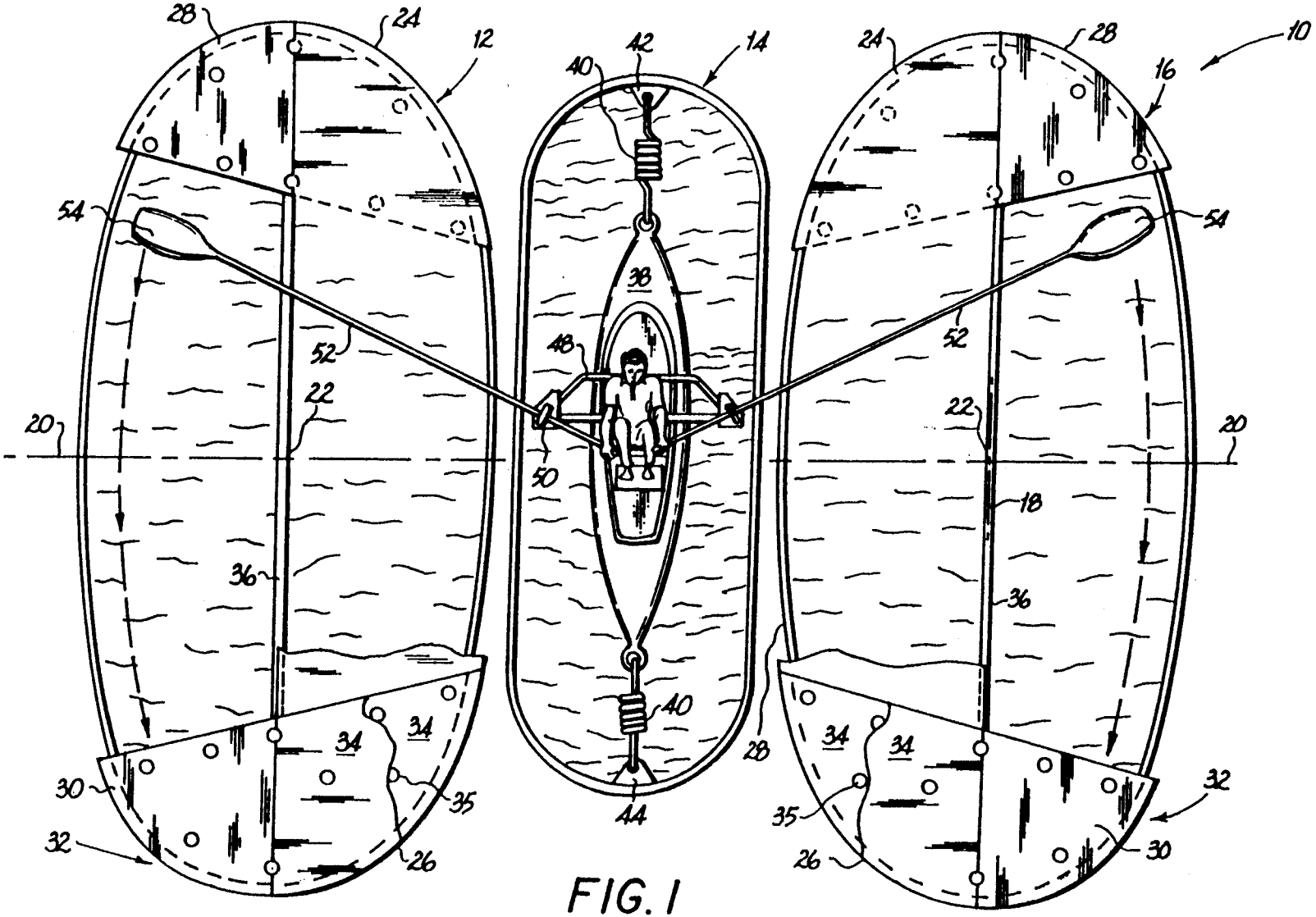
FIG. 1 is a plan view of the rowing apparatus according to my prior application.

To illustrate the present invention, reference is made first to FIG. 1, where there is shown a known rowing apparatus generally depicted by the numeral 10. The apparatus comprises three generally oblong tanks, 12, 14 and 16, which are normally filled with water and which serve to simulate a body of water such as a river or lake. These tanks can be molded from thin plastic or can be made from relatively thin aluminum sheets. The lateral or side tanks 12 and 16 are identical in shape and have a predetermined depth of water. Each tank 12 and 16 has a longitudinal axis 18 and an orthogonal axis with both axes intersecting at the center 22 of each tank. The ends 24 and 26 of each tank 12 and 16 are generally semicircular and include covers 28 and 30 to prevent water from splashing out.

Below each of the covers 28 and 30 there is provided a flow diverter 32 to reduce wave action and provide laminar flow of the water circulating around the ends 24 and 26 through tanks 12 and 16. Flow diverters 32 are composed of a series of generally semicircular horizontal plates 34 which are stacked one above the other at predetermined spaced vertical intervals by supporting pegs 35. Generally, three such plates 34 are provided at each end in each flow diverter.

Each tank 12 and 16 also has a solid vertical bulkhead 36 which divides the tank along the longitudinal central axis into two parallel sections and has a height just above the water line. The bulkhead extends from diverter 32 at one end 24 to the diverter 32 at the other end 26.

The third or middle tank 14 is also generally oblong in shape and of the same depth as tanks 12 and 16 and can be filled with water and standard rowboat or sculling boat 38 is placed therein. Boat 38 is suspended, by spring means 40, at both the fore and aft ends to the respective ends 42 and 44 of the tank 14. The boat 38 is equipped with a rowing attachment generally denoted as 46 which includes outriggers 48 and oarlocks 50 for oars 52.

The boat 38 floats on the waiter and has a certain degree of resilient forward and aft movement in response to the movement of the oars 52 in the water in each of the side tanks 12 and 16.

The oars 52 extend over the adjacent wall and center divider of each of the respective side tanks so that their paddles 54 can be immersed in the water on the longitudinal half of each side tank 12 and 16 remove from the rower.

As thus described, the apparatus shown in FIG. 1 conforms to that of my aforementioned patent to which reference can be made as if more fully set forth herein. The present invention can now be easily described here with reference to this prior structure.

Briefly, the present invention provides:

1) an improved center divider with means for more effectively circulating the water and preventing high resistance to the oar;
2) an improved diverting assembly at each end of the side tank so as to minimize cavitation and wave production;
3) an improved rower's boat providing a more sensitive realistic response to the rower.

I. The Center Divider

Figure 2:
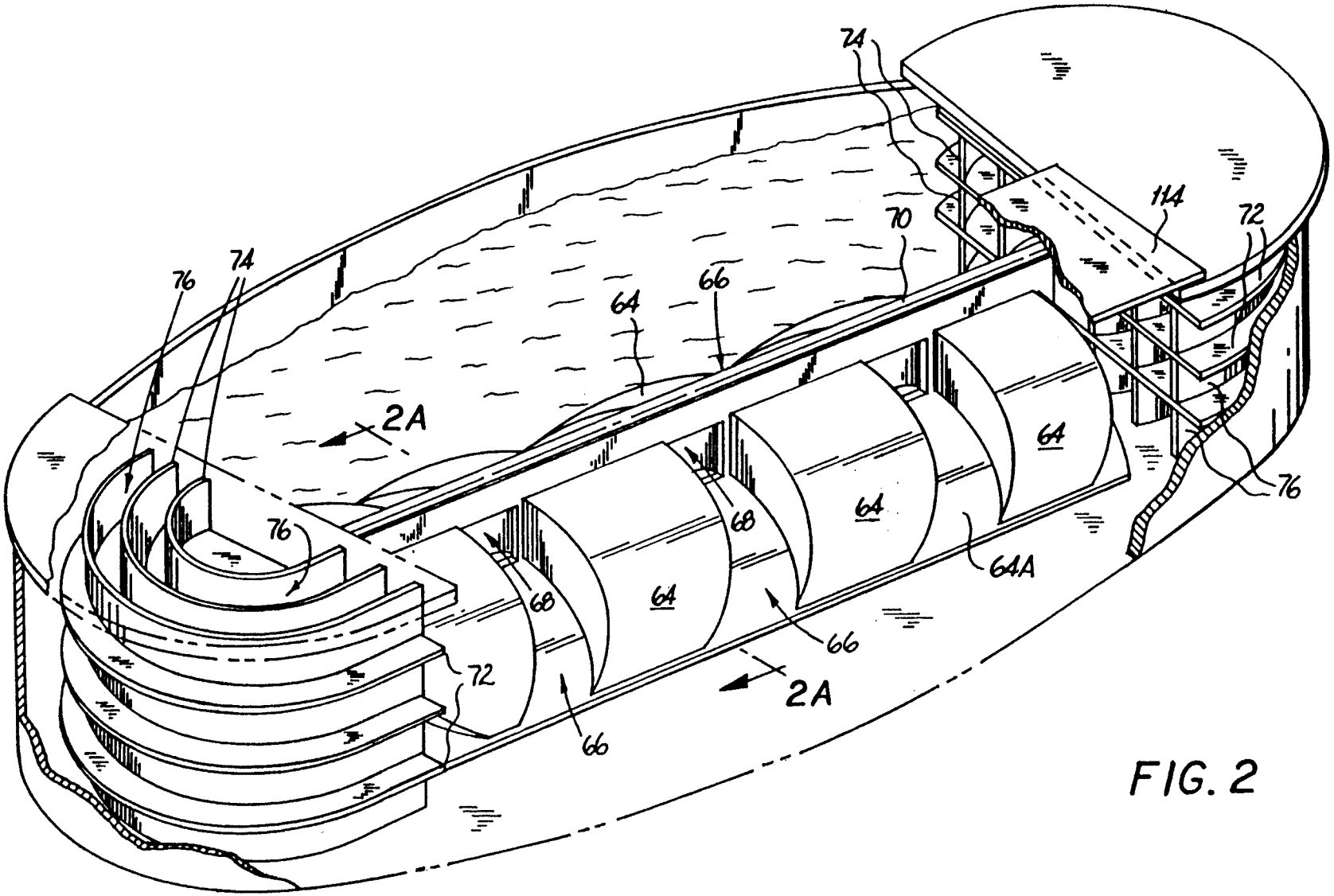
FIG. 2 is a perspective view of a side tank in which the improvements of the present invention are embodied.
Figure 2A:
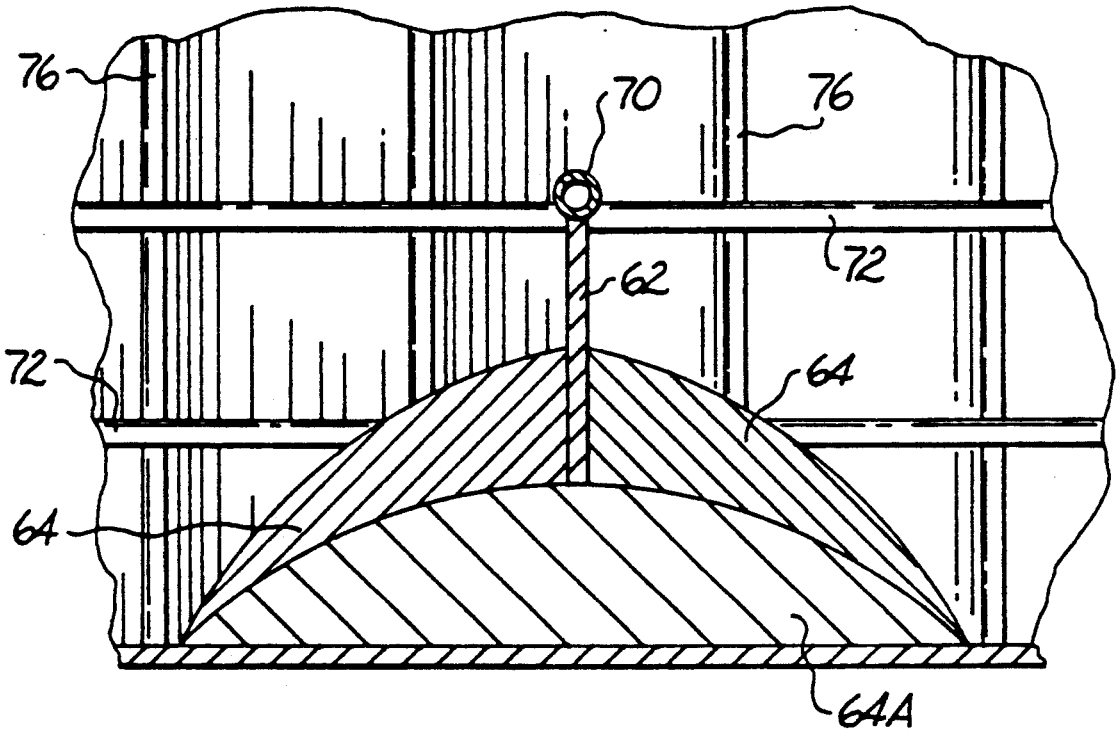
FIG. 2A is a cross-sectional view along lines 21-2A of FIG. 2.
Figure 3:
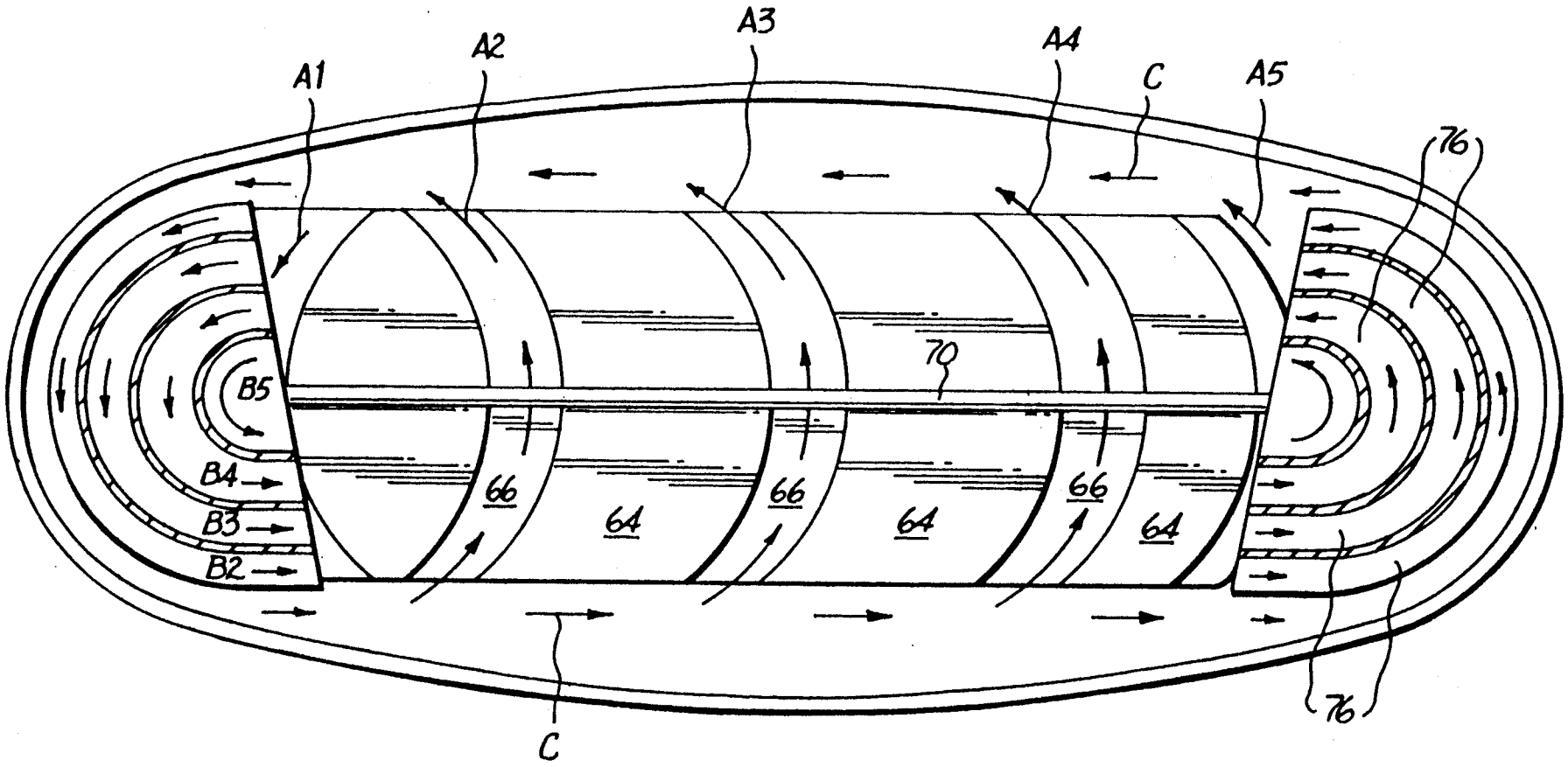
FIG. 3 is a plan view of a side tank of FIG. 2 schematically illustrating the improved water flow resulting from the present invention.

As seen in FIG. 2, the present invention provides a center divider assembly, generally depicted by the numeral 60, comprising a bulkhead 62 having a plurality of compound arcuate wall members shape 64 on opposite sides of the bulkhead 62. The wall members 64, preferably in the form of solid blocks, extend laterally and rearwardly and are spaced from each other to provide a series of ducts 66 between adjacent blocks. The blocks 64 slope downwardly from a height just below the upper edge of the bulkhead 62 towards the outer edge of the tank as seen in the cross section shown in FIG. 2A. The bulkhead 62, itself is provided with a hole 68 corresponding in size to the dimension of the ducts 66 so that the ducts on each side of the bulkhead are in communication with each other and permit flow of water in the ducts for example unabated by the arrow A1-A5 in FIG. 3.

Above all, the curvature of the blocks 64 are easily modifiable and may extend generally perpendicular to the center bulkhead. Thus, rather than solid members, they can be in the form of plates or fins extending laterally. Hollow members may also be used.

The blocks 62 need not extend laterally from the center bulkhead to the outer wall of the tank, but they should be dimensioned in their slope and extent so as not to interfere with the oar as the rower dips, pulls and raises the oar. The exact dimensions are not otherwise critical and can be easily determined without undo experimentation once the dimensions of the tanks 12, 14 and 16 are determined. Further, the axial spacing (or distance of the duct 66) between the blocks 62 is also not critical. Such spacing, however, should be big enough to provide ample transverse flow without disturbing the desired circular flow described in my earlier patent. The divider assembly may be made in one piece or several pieces of wood, plastic, metal or other material.

If desired, the central bulkhead 62 may be omitted and the laterally spaced blocks 64 may be joined together. The height of the blocks must, of course, be chosen so that at least along the central axis the two sides of the tank are separated. The blocks 64, as shown, seat upon a dome shaped saddle 64A which also provides a curved bottom for the duct 66.

Lastly, the bulkhead 62 is provided with a circular edge 70 along its top providing a rounded surface for the oar to rest or slide on, preventing the oar from being scratched or chipped by an otherwise square edge bulkhead. The rounded surface can be effected by placing a hollow pipe, round dowel or hose over the edge.

II. The End Diverter

Again, as seen in FIG. 2, the end diverter, as provided in my prior patent, comprises a number of plates 72 stacked at predetermined spaced intervals one above the other. However, unlike my prior construction, the plates 72 are spaced and supported on each level by a plurality of semicircular walls 74 arranged to nest at spaced intervals from each other to define arcuate ducts 76 parallel to the curve of each end wall. Thus, not only is the water at each end divided into horizontal laminar by the plates 72, but it is also divided into separate independent flow paths with each of the separate ducts 74 in each laminar following the paths shown by the arrows b1-b4 in FIG. 3. As a result, cavitation wave creation and turbulence is reduced to a minimum.

In use, the oarsman sits in the center tank 14 and rows simulating actual rowing on the river or lake. The oars 52 dip, as indicated, into the far side portion of the latter tanks 12 and 16 pushing the water in the direction indicated by the arrow C, circularly about the tank in a continuous stream. Portions of the water are short circuited through the ducts 66 via arrows A relieving the friction and resistance of the water to the oarsman's stroke. In addition, the water passing through the end diverter ducts 76, arrows B, enhance the flow about the circular ends by significantly reducing the friction and turbulence which would normally occur in turning a single larger mass of water around the ends. Thus, a more realistic rowing occurs giving the rower the sense of being on an open river or lake where the water flows freely.

III. The Improved Rowing Seat

Figure 4:
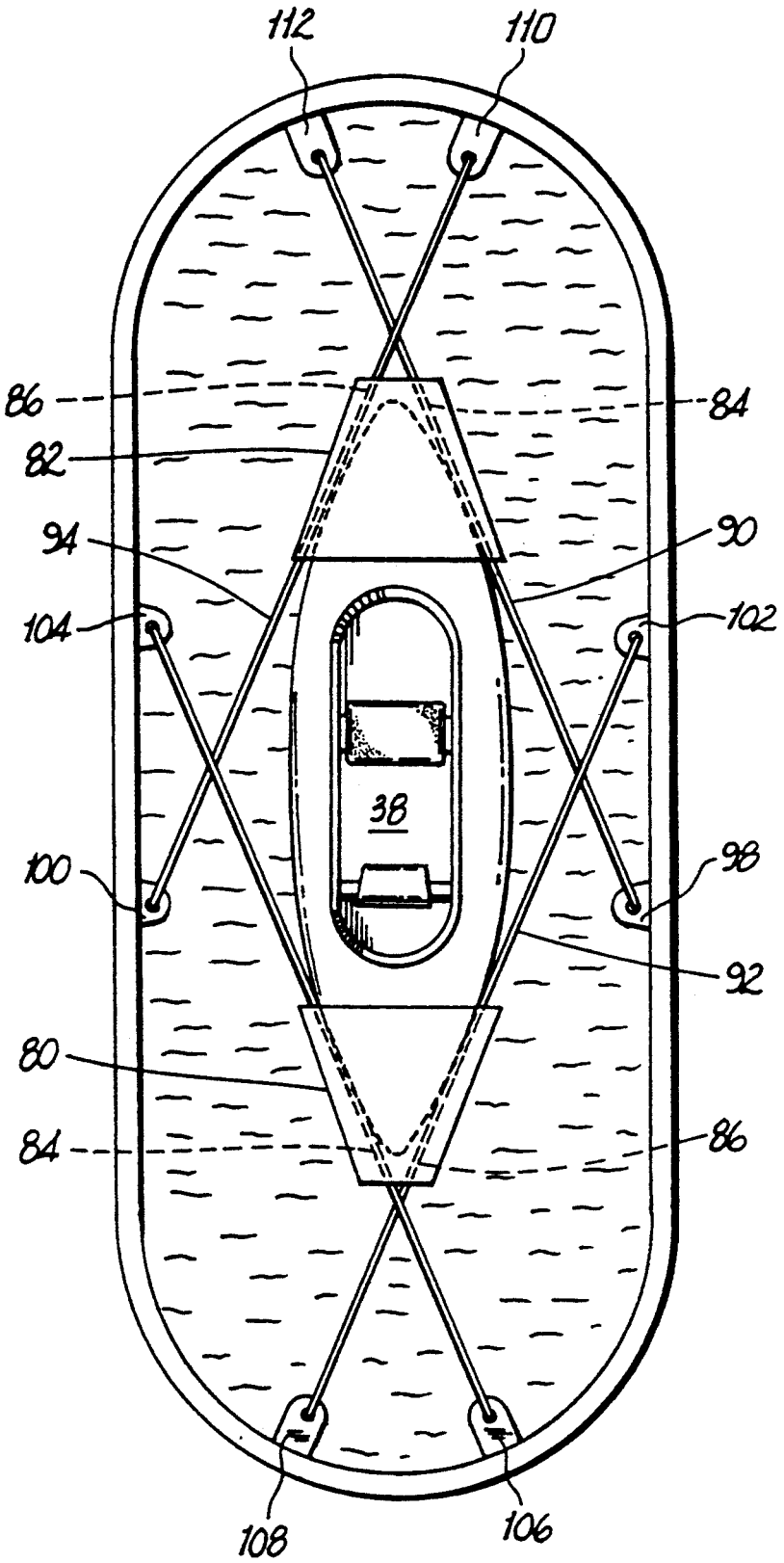
FIG. 4 is a plan view of the center or rower's tank to which an improved seat is applied.

Turning to FIG. 4, the boat 38 is provided with sheaths 80 and 82 fixedly mounted to the back of the forward and rear ends respectively. The sheaths 80 and 82 are conical in form, may be made of wood, aluminum or plastic and are securely fastened to the boat so as to be conjointly attached. Extending through each sheath 80 and 82 are a pair of elongated tubes 84, 86 which intersect at an apex coincident with the apex of the respective boat end. The paired tubes 84 and 86 are on the same horizontal plane. Passing through each tube 84 and 86 is a cable 90, 92, 94 and 96, preferably of wound wire. Located midway between the seat on which the oarsman sits and the ends of the tank 14 and fixed on each of the opposing side walls, are a pair of fittings 98, 100, 102 and 104. Cables 90 and 94 are each attached at one end to one fitting 98 and 100 respectively while cables 92 and 96 are each attached at one end to the fitting 102 and 104 respectively. Paired brackets 106, 108 and 110, 112 are located at each of the tank 14 to which the free ends of them are respectively fixed.

In the foregoing manner, the boat is held sling-like in a side hammock formed of the four cables and is slideable (more or less depending on the force exerted by the oarsman) along the cables for and aft. With this arrangement the bounce or vertical movement of the boat, permitted by the resilient springs of my prior patent, is reduced and the boat has the feel of realistic buoyancy in the water.

Various features shown in my earlier patent may be used as well with the present invention. For example, a safety and splash cover 110 (FIG. 2) may be applied only the outside half of the tank. The tanks may be reinforced and set on a concrete foundation for added safety.

While several of the embodiments and examples of the present invention have been illustrated and described, it is obvious that many changes and modifications may be made thereunto, without departing from the spirit and scope of the invention.

What is claimed is:

1. An apparatus for training rowers having an oblong tank filled with water and in which the rower manipulates an oar to simulate rowing, the improvement comprising a tank, a rowing simulator, a tank dividing assembly extending longitudinally in said tank to separate said tank into two parallel sections and to cause the flow of water created by the simulated rowing to take a circular path within said tank, said dividing assembly being provided with a plurality of transverse passages intermediate the tank ends for short circuiting at least a portion of the water from one parallel section to the other.

2. The apparatus according to claim 1 wherein said dividing assembly comprises a plurality of axially spaced laterally extending wall members defining between adjacent pairs of said members said transverse passages, said wall members having an upper surface sloping from a height approximating the level of water in said tank to bottom of said tank in each of the parallel sections.

3. The apparatus according to claim 2 wherein the slope of said wall members is curved.

4. The apparatus according to claim 2 wherein the facing surfaces of adjacent paired wall members are curved to form arcuate passageways to direct the flow of water in the transverse path.

5. The apparatus according to claim 4 wherein said passageways are parallel to each other.

6. The apparatus according to claim 2 wherein said dividing assembly includes a vertical bulkhead extending above the level of said wall members.

7. The apparatus according to claim 6 wherein said wall members are divided into two parts separated by said vertical bulkhead, said vertical bulkhead having openings aligned with each passageway.

8. The apparatus according to claim 6 wherein said bulkhead is provided with a rounded edge over which the oar may slide during simulated rowing.

9. An apparatus for training rowers having an oblong tank filled with water and in which the rower manipulates an oar to simulate rowing, the improvement comprising a tank, a rowing simulator, a flow diverter located at at least one end of said tank, said diverter comprising a plurality of horizontally disposed, vertically spaced plates, said plates being separated and supported by a plurality of vertically oriented walls spaced parallel to each other between adjacently stacked pairs of said plates to define a plurality of passageways between said plates.

10. The apparatus according to claim 9 wherein said vertically oriented walls are semicircular.

11. An apparatus for training rowers having an oblong tank filled with water and in which the rower manipulates an oar to simulate rowing, the improvement comprising a tank, a rowing simulator, a flow diverter located at each end of said tank, said diverter comprising a plurality of horizontally disposed, vertically spaced plates, said plates being separated and supported by a plurality of semicircular vertically oriented walls arranged parallel to each other between adjacent pairs of said plates to define a plurality of passageways between said plates, a tank dividing assembly extending longitudinally in said tank between said end diverters and separating said tank into two parallel sections to cause the flow of water created by the simulated rowing to take a circular path through said parallel sections and said end diverters, said dividing assembly being provided with a plurality of transverse passages for short circuiting at least a portion of the water from one parallel section to the other.

12. An apparatus for training rowers having a tank filled with water for suspending a boat in which the rower sits and manipulates an oar, the improvement comprising a tank, a rowing simulator, wherein said boat is suspended by a plurality of cables attached to said boat to permit said boat to slide relative to said cables fore and aft in said tanks and further comprising a sheath attached to each end of said boat, each sheath having a pair of tubular passages extending at angles to each other and adapted to slideably receive a cable, the respective cables being attached in crossing fashion at one end to the respective end of said tank and at the opposite ends to opposing sides of said tank proximate the other end of said tank.

* * * * *